US006144275A

United States Patent [19]

Hirata et al.

[11] Patent Number: 6,144,275

[45] Date of Patent: Nov. 7, 2000

[54] SOLENOID ACTUATOR

[75] Inventors: Ichiro Hirata, Sagamihara; Norio Uemura; Hideki Higashidozono, both of Fujisawa; Koji Watanabe, Kamakura; Kazuya Kimura, Kariya; Kazuhiko Minami, Kariya; Hiroshi Uneyama, Kariya; Masahiro Kawaguchi, Kariya, all of Japan

[73] Assignees: NOK Corporation, Tokyo; Kabushiki Kaisha Toyoda Jidoshokki Seisakusho, Kariya, both of Japan

[21] Appl. No.: 09/349,466

[22] Filed: Jul. 9, 1999

[30] Foreign Application Priority Data

Jul. 9, 1998 [JP] Japan ..... 10-210441
Jul. 9, 1998 [JP] Japan ..... 10-210450

[51] Int. Cl.[7] ..... H01F 3/00

[52] U.S. Cl. ..... 335/262; 251/129.15

[58] Field of Search ..... 335/126, 131, 335/220, 221, 229, 262, 250, 251, 252, 262.3; 251/129.15, 129.16

[56] References Cited

U.S. PATENT DOCUMENTS

| | | | |
|---|---|---|---|
| 3,731,880 | 5/1973 | Williams | 239/584 |
| 5,582,153 | 12/1996 | Dutt et al. | 123/450 |
| 5,649,687 | 7/1997 | Rosas et al. | 251/129.15 |
| 5,856,771 | 1/1999 | Nippert | 335/262 |
| 5,895,026 | 4/1999 | Linkner, Jr. et al. | 251/129.15 |

*Primary Examiner*—Lincoln Donovan
*Attorney, Agent, or Firm*—Jacobson, Price, Holman & Stern, PLLC

[57] ABSTRACT

The solenoid actuator (26) is designed to be installed within a mounting bore (22) formed in a support housing (24). The solenoid actuator (26) is provided at its top with an end cap (46) made of molded plastics which is configured to be closely fitted in the mounting bore (22) to close the opening of the bore. When the actuator is installed within the mounting bore (22), the end cap (46) protects underlying yoke member (40/64), armature (80) and magnetic pole piece (74) from attack by corrosive substance.

18 Claims, 8 Drawing Sheets

SOLENOID ACTUATOR

BACKGROUND OF THE INVENTION

1. Field of the Invention

The present invention relates to a solenoid actuator and, more particularly, to a solenoid actuator which may be suitably incorporated, for example, in a solenoid valve for use in automotive engines and engine accessories.

2. Description of the Prior Art

Solenoid actuators are widely used in various fields of industries. An example of application of the solenoid actuators includes solenoid valves which are used to control flow of fluids in accordance with varying electric signals.

As shown in FIGS. 1A and 1B of the accompanying drawings, a solenoid valve typically includes a solenoid coil 1 wound around a magnetic pole piece 2. An armature 3 as a movable member is arranged in alignment with the pole piece and is linked to an output rod 4 which is intended to control a valve section 5 shown only schematically.

The solenoid coil 1 is surrounded by a magnetic yoke member which operates to magnetically couple the pole piece 2 and the armature 3 with each other. In most instances, the yoke member is made of an outer casing 6 and a separate upper plate 7 which are assembled together by inwardly crimping the uppermost end 8 of the outer casing 6 as shown. As the solenoid coil 1 is energized, a path of magnetic flux will be formed across the yoke member, armature 3 and the pole piece 2 to attract the armature toward the pole piece.

In use, it has been customary to install the solenoid valve on a support housing by using bolts or screws. To this end, the solenoid valve is generally provided with a mounting bracket 9 by which the solenoid valve is bolted to the support housing 10. As a result, the solenoid valve as installed on the housing is generally exposed to the ambient atmosphere.

An essential designing requirement for a solenoid actuator is that the magnetic component parts thereof, such as yoke, pole piece and armature, which are intended to form the magnetic flux path must all be made of a ferromagnetic material such as iron and ferrous alloy.

One of the problems which must be overcome in designing a solenoid actuator which is durable and has a prolonged service life is that the ferromagnetic material which is used to fabricate the yoke, pole piece and armature is apt to rust.

Particularly, in automotive applications wherein the solenoid actuators and solenoid valves are mounted on automotive engines and engine accessories, the solenoid actuators are subjected to chemical attack by sodium chloride and calcium chloride which are spread on the road surface in the cold seasons as an antifreezing agent, so that the yoke, pole piece and armature of the solenoid actuators will be readily corroded.

Corrosion by the antifreezing agent is accelerated thermally because the automotive engine rooms are held at an elevated temperature ranging from 80° C. to 120° C. Furthermore, the solenoid coil evolves heat as it is energized so that the solenoid actuators are heated at a high temperature which may occasionally reach 150° C.

As in this way the solenoid actuators are placed in extremely corrosive conditions, the yoke, pole piece and armature which are made of a ferromagnetic material would be readily corroded unless subjected beforehand to a high degree of rust prevention process such as plating. The bracket 9 and bolts must also be adequately plated to prevent premature rust formation.

High quality plating such as plating with nickel-zinc alloys and formation of a thick layer of plating is costly to perform and hinders reduction in the production costs.

Accordingly, it is an object of the present invention to provide a solenoid actuator having a design which is adapted to present a high degree of anti-corrosion property.

Another object of the invention to provide a solenoid actuator which is rust free and yet may be manufactured at limited production costs.

Another problem encountered with the conventional solenoid actuators is that a substantial labor is required during installation work because the mounting brackets must be carefully positioned and the bolts firmly fastened.

Accordingly, another object of the invention is to provide a solenoid actuator which is easy to install.

A still another object of the invention is to provide a solenoid actuator which is easy to assemble and easy to manufacture.

SUMMARY OF THE INVENTION

To achieve the foregoing objects, this invention provides a solenoid actuator which is specifically designed to be installed within a mounting bore or lodgment formed in a support housing.

According to the invention, the solenoid actuator comprises a solenoid coil, a magnetic pole piece, a movable armature, a magnetic yoke member, an output rod, and an end cap member arranged to overlie the yoke member, the armature and the pole piece. The end cap member is made of a non-corrodible material, preferably plastics, and is sized and configured to be closely fitted in the mounting bore of the support housing.

With this arrangement, when the solenoid actuator is installed in the mounting bore formed in the support housing, the end cap member is brought into contact with the inner wall of the bore to fluid-tightly close the opening of the mounting bore. As a result, the end cap member protects the underlying yoke member, armature and magnetic pole piece from attack by corrosive substance which may be present in the ambient environment. Accordingly, the yoke member, armature and magnetic pole piece are free from rust formation even though they are made of a ferromagnetic material and are only subjected to a minimum grade of plating.

Another advantage of the solenoid actuator according to the invention is that it can be installed on the support housing by simply inserting the actuator into the mounting bore of the housing and by axially positioning the actuator by a circlip snap fitted in a groove formed on the inner wall of the mounting bore. Accordingly, the solenoid actuator according to the invention is easy to install.

In addition, as the solenoid actuator is installed on the support housing without using the conventional mounting bracket and bolts, the solenoid actuator of the invention is free from the problem of corrosion and rusting of bracket and bolts.

Preferably, the end cap member is provided at the circumferential periphery thereof with an annular groove in which an annular sealing member such as an O-ring is fitted. Use of the sealing member is advantageous in establishing a high degree of fluid tightness between the end cap member and the housing so that ingress of corrosive substance is perfectly precluded.

In a preferred embodiment of the invention, the solenoid actuator is made of an upper section and a lower section which are prefabricated in the form of separate modules. The upper section is made of a molded plastic which is molded integrally with the end cap member and in which the solenoid coil and an upper plate of the yoke member are insert molded. The lower section may include an outer casing of the yoke member and a sleeve of a non-magnetizable material in which the armature and the pole piece are housed at least partly.

The upper and lower sections or modules may be assembled together by interference fit or bayonet coupling. Therefore, the solenoid actuator of the invention may be manufactured and assembled without recourse to crimping. This provides a substantial advantage from the view point of production safety since use of a press machine can be avoided. As the upper section consists primarily of molded plastics whereas the lower section consists solely of metallic parts, materials forming the solenoid actuator can be readily separated for recycle.

In the case that the upper and lower sections are assembled with each other by the bayonet coupling, it is preferably to provide means for preventing relative rotation of the two sections. The means for preventing relative rotation may include a notch in which a projection of the bayonet coupling is engaged. Alternatively, the means for preventing relative rotation may include a series of serration formed on a side of the slot and a plurality of teeth formed on the opposite side of the projection.

According to another embodiment of the invention, the solenoid actuator includes a sleeve disposed at the center of the solenoid coil. The sleeve is made of a non-magnetizable, non-corrodible material such as stainless steel. The sleeve is closed at its upper end and the armature is housed in the sleeve. An annular end cap member, similarly made of a non-corrodible material such as molded plastics, surrounds the upper part of the sleeve and fluid-tightly seals the sleeve with respect to the inner wall of the mounting bore of the support housing to thereby protect the yoke member from attack by corrosive substance.

The advantage of this embodiment is that the overall axial length of the solenoid actuator can be limited.

These features and advantages of the invention, as well as other features and advantages thereof, will become apparent from the following description.

DESCRIPTION OF THE PREFERRED EMBODIMENTS

Figure 1A:
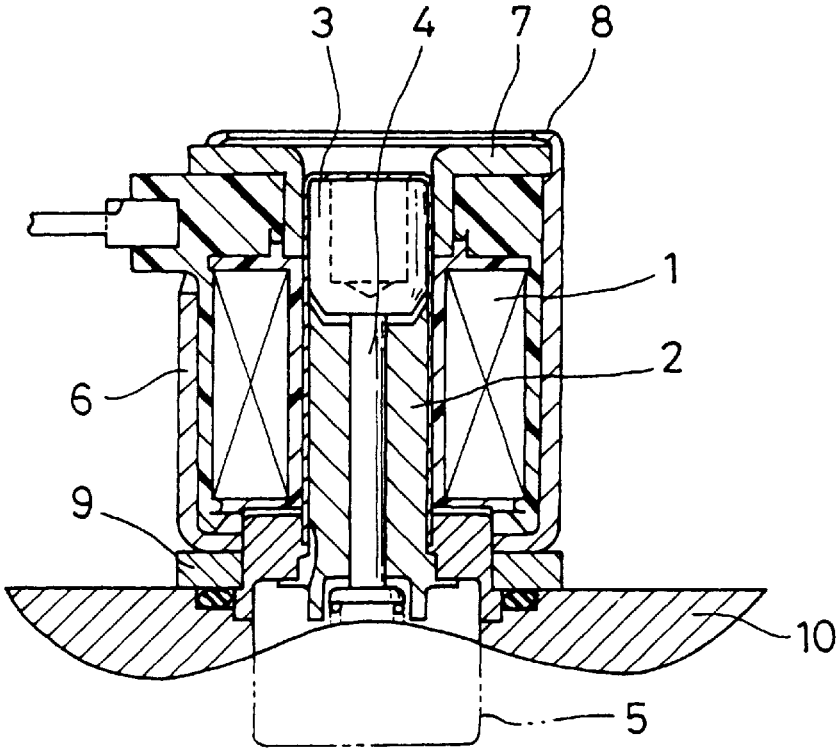
FIG. 1A (PRIOR ART)
FIGS. 1A and 1B are a cross-sectional view and a top plan view, respectively, of the solenoid valve of the conventional design.
Figure 1B:
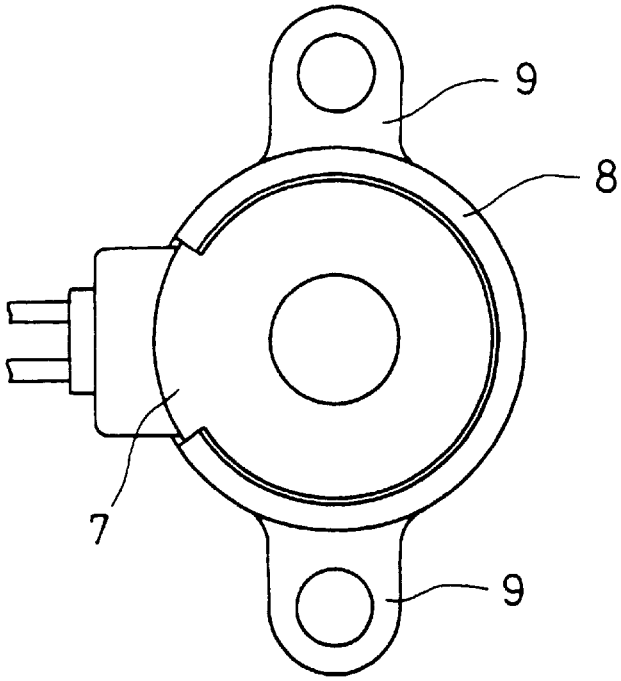
FIG. 1B (PRIOR ART)
Figure 2:
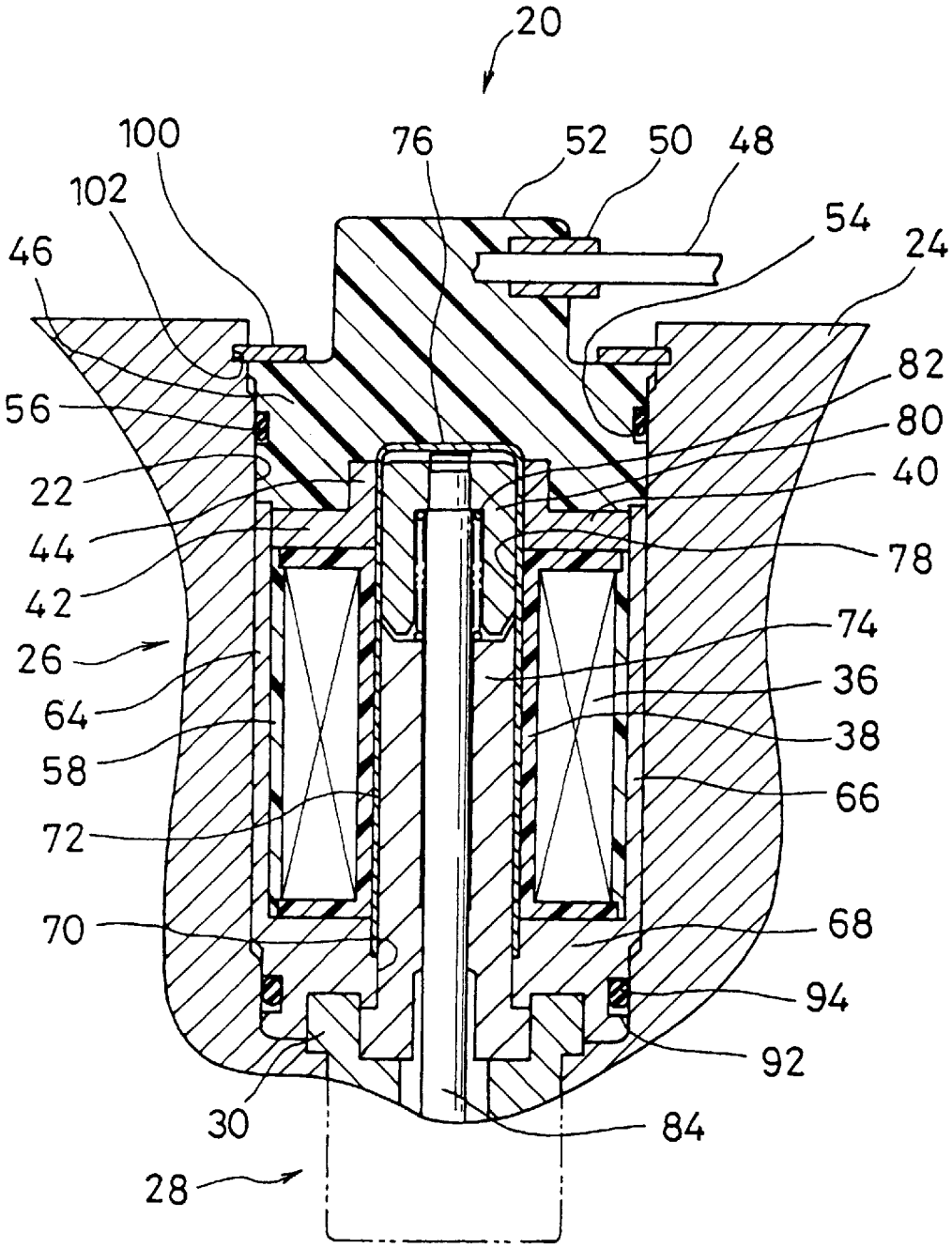
FIG. 2 is a cross-sectional view of a solenoid valve incorporating the solenoid actuator according to the first embodiment of the invention.
Figure 3:
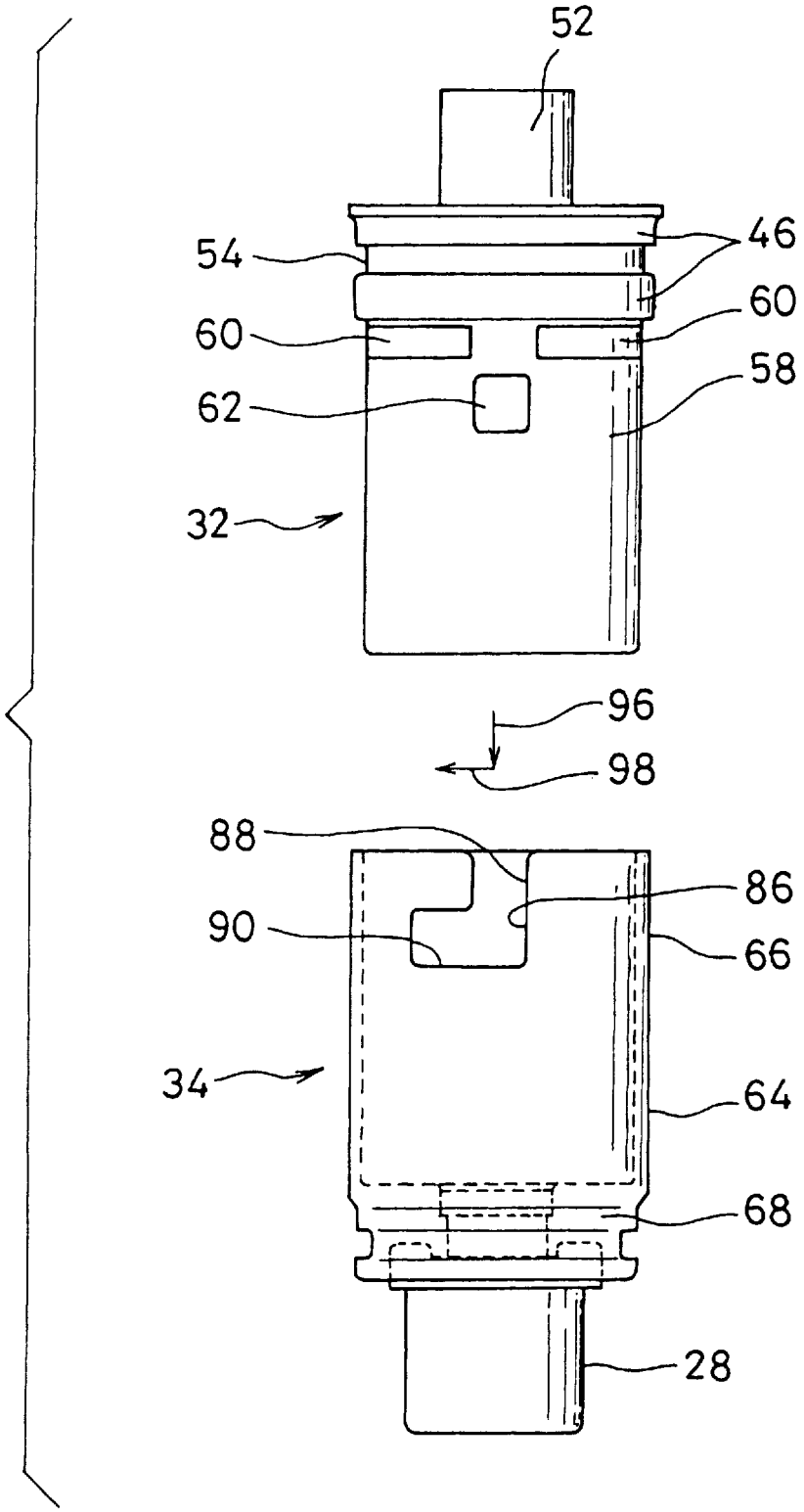
FIG. 3 is a side elevational view of the solenoid valve shown in FIG. 2 and showing the upper and lower modules prior to assembly.

In FIGS. 2 and 3, there is shown a solenoid valve incorporating the solenoid actuator according to the first embodiment of the invention. Referring to FIG. 2, the solenoid valve 20 is designed to be installed within a mounting bore or lodgment 22 formed in a suitable support housing 24. By way of an example, the support housing 24 may be a housing for a refrigerant compressor of an automotive air-conditioning system and the solenoid valve 20 may be used to control the delivery rate of the compressor.

The solenoid valve 20 is comprised of the solenoid actuator 26 embodying the invention and of a valve section 28 having a valve housing 30 mounted to the lower end of the actuator 26.

As will be apparent from FIG. 3, the solenoid valve 20 incorporating the solenoid actuator 26 consists of an upper module or section 32 and a lower module or section 34 assembled with each other by a bayonet coupling described later.

Referring again to FIG. 2, the upper module 32 of the solenoid actuator 26 includes a solenoid coil 36 wound around a solenoid bobbin 38 which is made of molded plastics. An upper plate 40 forming part of a magnetic yoke member is insert molded in the upper module 32. The upper plate 40 is comprised of a radially extending portion 42 and a tubular portion 44. The upper plate 40 is made of a ferromagnetic metal and has been subjected merely to a low grade plating.

The upper module 32 further includes a generally tubular end cap member 46 formed by molding of a plastic material such as "Nylon 66", polybutyleneterephthalate, and polyphenylenesulfide. Alternatively, the end cap member 46 may be made from a stainless steel such as "SUS 304" according to the Japanese Industrial Standard (JIS). Sheathed lead wires 48 leading from the solenoid coil 36 extend through a grommet 50 mounted to a head 52 of the end cap member 46.

The end cap member 46 is sized and configured to snugly fit within the mounting bore 22 of the support housing 24. The end cap member 46 has an annular groove 54 formed on the outer periphery thereof and a sealing ring such as an O-ring 56 is mounted in the groove 54 to establish a fluid-tight seal between the outer periphery of the end cap member 46 and the inner wall of the mounting bore 22.

The upper module 32 may be manufactured in the following manner. First, the solenoid bobbin 38 is made by molding of plastics and the solenoid coil 36 is wound around bobbin 38. The bobbin 38 with the solenoid coil 36 as well as the upper plate 40 are then subjected to insert molding whereby the end cap member 46 is formed integrally with a skirt portion 58 formed to surround the solenoid coil 36. The circumferential periphery 60 of the radial portion 42 of the upper plate 40 is exposed partly onto the outer periphery of the skirt portion 58 as shown in FIG. 3.

During the course of the afore-mentioned insert molding, a projection 62 forming part of the bayonet coupling is simultaneously formed in such a manner as to slightly project from the outer periphery of the skirt portion 58 as shown in FIG. 3.

The lower module 34 includes an outer casing 64 made of a ferromagnetic metal and forming another part of the yoke member. The outer casing 64 has a tubular portion 66 and a base portion 68 having a stepped central bore 70. Similar to the upper plate 40, the outer casing 64 has been subjected only to a low grade plating.

The lower module 34 also includes a sleeve 72 made of a non-magnetizable, non-corrodible material, preferably stainless steel. The upper end of the sleeve 72 is closed to form an armature chamber described later. The lower end of the sleeve 72 is fitted in the central bore 70 of the outer casing 64 and may be soldered thereto.

The lower module 34 further includes a magnetic pole piece 74, made of a ferromagnetic metal, which is also known in the art as a center post. The pole piece 74 is generally cylindrical in shape and has a substantial part closely enclosed by the sleeve 72. The lower part of the pole piece 74 extends downwards through the bore 70 of the outer casing and is firmly bonded to the base portion 68 of the outer casing 64 by means such as soldering.

The upper end of the pole piece 74 is spaced for a distance from the closed upper end wall 76 of the sleeve 72 so that a space serving as an armature chamber 78 is formed within the upper part of the sleeve 72.

A movable armature or plunger 80 made of a ferromagnetic material is loosely received in the armature chamber in a manner to permit axial movement. The armature 80 is upwardly biased by a return coil spring 82 having its lower end seated on the upper end face of the pole piece 74.

An output rod 84 extends through a central bore of the pole piece 74 and is connected at its upper end to the armature 80. The lower end of the output rod 84 is suitably connected to a valve element, now shown, of the valve section 28 to transfer the movement of the armature 80 to the valve element as the solenoid coil 36 is energized.

As shown in FIG. 3, the tubular portion 66 of the outer casing 64 is formed with a J-shaped slot 86 forming part of the bayonet coupling. The slot 86 includes an axially extending portion 88 and a circumferentially extending portion 90.

The outer casing 64 is also provided at its base portion 68 with an annular groove 92 in which an O-ring 94 can be mounted to prevent leakage of a fluid from the valve section 28.

The upper module 32 and the lower module 34 are assembled together to form the solenoid valve 20 by inserting the upper module 32 into the lower module 34 in the axial direction as shown by the arrow 96 in FIG. 3 until the projection 62 engages the circumferentially extending portion 90 of the J-shaped slot 86 and by thereafter turning the upper module 32 in the circumferential direction as shown by the arrow 98.

In the solenoid valve 20 as assembled, the circumferential edge 60 of the radial portion 42 of the upper plate 40 closely mates and fits with the inner wall of the tubular portion 66 of the outer casing 64 so that the upper plate 40 and the outer casing 64 are magnetically intimately coupled with each other to form a unitary yoke member. It will be noted that, as the solenoid coil 36 is energized, the magnetic pole piece 74, the outer casing 64, the upper plate 40 and the armature 80 will cooperate together to form a looped path of magnetic flux, with a magnetic gap being present between the armature 80 and the pole piece 74. The wall thickness of the sleeve 72 made of stainless steel is made small enough to ensure that an adequately strong magnetic coupling is established between the upper plate 40 and the armature 80.

The solenoid valve 20 thus assembled is installed on the support housing 24 by insertion into the mounting bore 22, with the O-rings 56 and 94 fitted, respectively, in the grooves 54 and 92. Thereafter, a circlip 100 is mounted in an annular groove 102 on the inner wall of the bore 22 as shown in FIG. 2, to axially locate the solenoid valve 20. In this way, the solenoid valve 20 can be installed in a simple manner without using bolts or screws.

During use, the end cap member 46 made of plastics intercepts the underlying ferromagnetic parts from the ambient atmosphere and protects the upper plate 40 and the outer casing 64 of the yoke member from attack by any corrosive substances. The upper O-ring 56 serves to shut out ingress of undesirable substances. Accordingly, the upper plate 40 and the outer casing 64 are free from rust formation for a long period of time.

Figure 4:
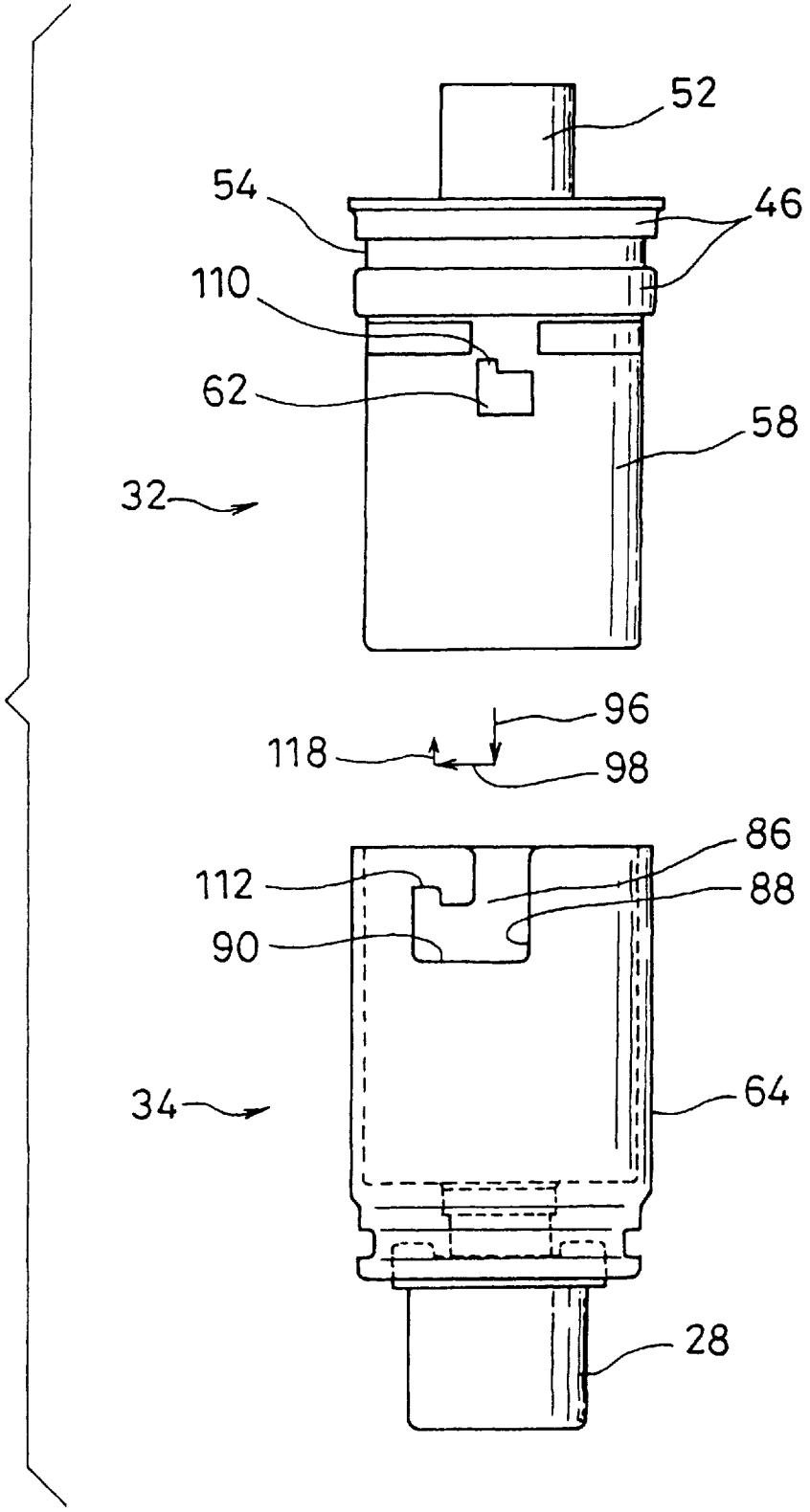
FIGS. 4 and 5 are views similar to FIGS. 3 and 2, respectively, but showing a solenoid valve incorporating the solenoid actuator according to the second embodiment of the invention.
Figure 5:
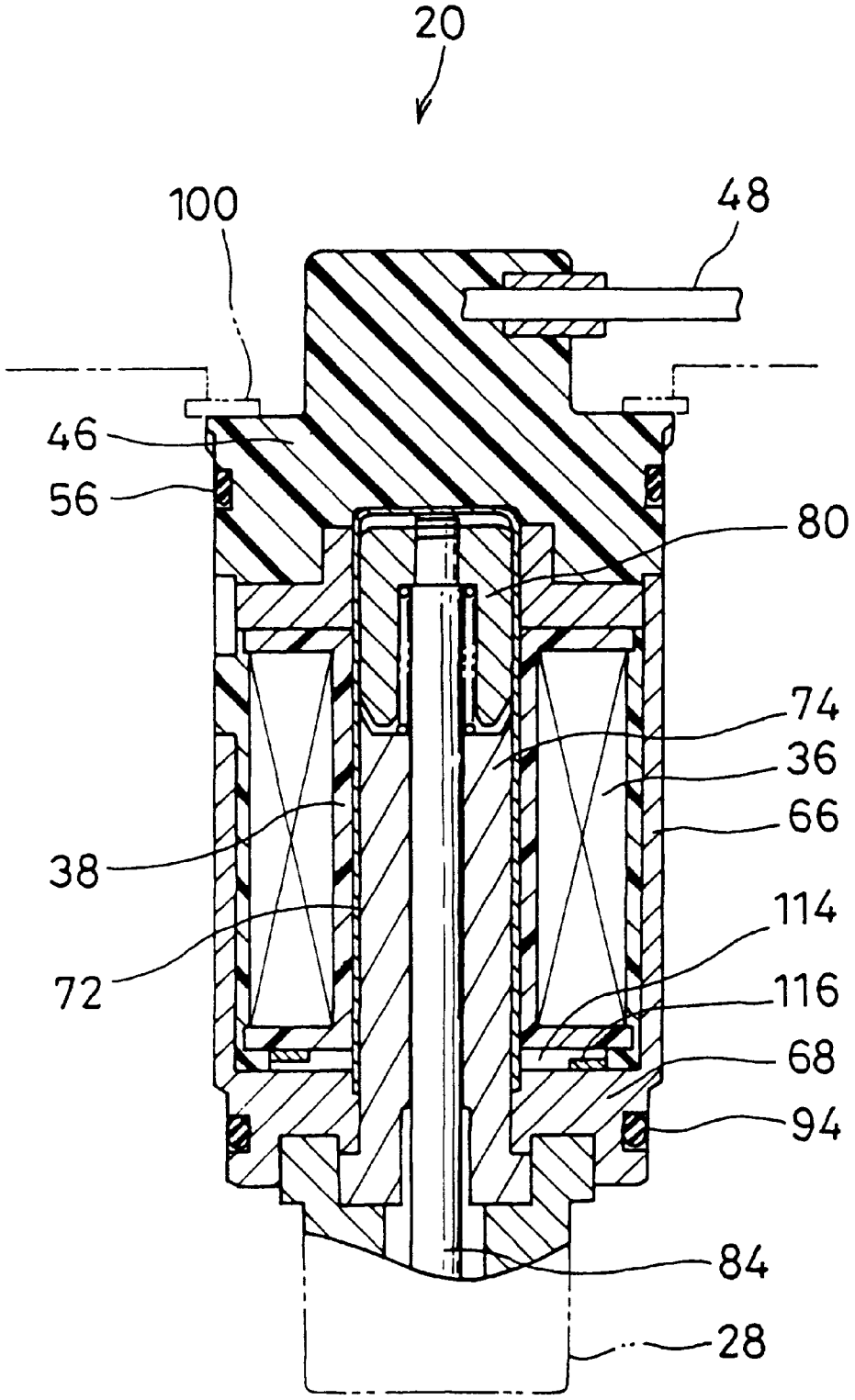

FIGS. 4 and 5 illustrate a solenoid valve incorporating the solenoid actuator according to the second embodiment of the invention. Parts and members similar to those of the first embodiment are designated by like reference numerals and, therefore, will not be described again. To describe only the difference, the projection 62 provided on the skirt portion 58 of the upper module 32 to form part of the bayonet coupling is provided with a upwardly directed lug 110 as shown in FIG. 4. Correspondingly, an upwardly directed notch 112 is formed at the end of the circumferentially extending portion 90 of the J-shaped slot 86.

An axial gap 114 is formed at the bottom of the lower module 32 and a spring washer 116 is arranged in the gap 114 to bias the upper module 32 away from the lower module 34 when the modules are assembled.

The modules 32 and 34 of the second embodiment are similarly assembled together by forcing the upper module 32 into the lower module 34 in the axial direction as shown by the arrow 96, followed by relative rotation in the circumferential direction as shown by the arrow 98 until the projection 62 abuts against the end of the circumferential portion 90 of the slot.

Upon release of the axial pressure applied to the upper module 32, the spring washer 116 will urge the upper module 32 to move upwardly away from the lower module 34 as shown by the arrow 118 in FIG. 4 to thereby bring the lug 110 into engagement with the notch 112. As a result, the upper and lower modules 32 and 34 are positively locked with each other. In this way, the lug 110 and the notch 112 cooperate with each other to serve as a means to prevent relative rotation of the upper and lower modules.

Although not shown in the drawings, positive lock of the upper and lower modules 32 and 34 may alternatively be carried out by permanently deforming one or both of the slot 86 and the projection 62.

Figure 6:
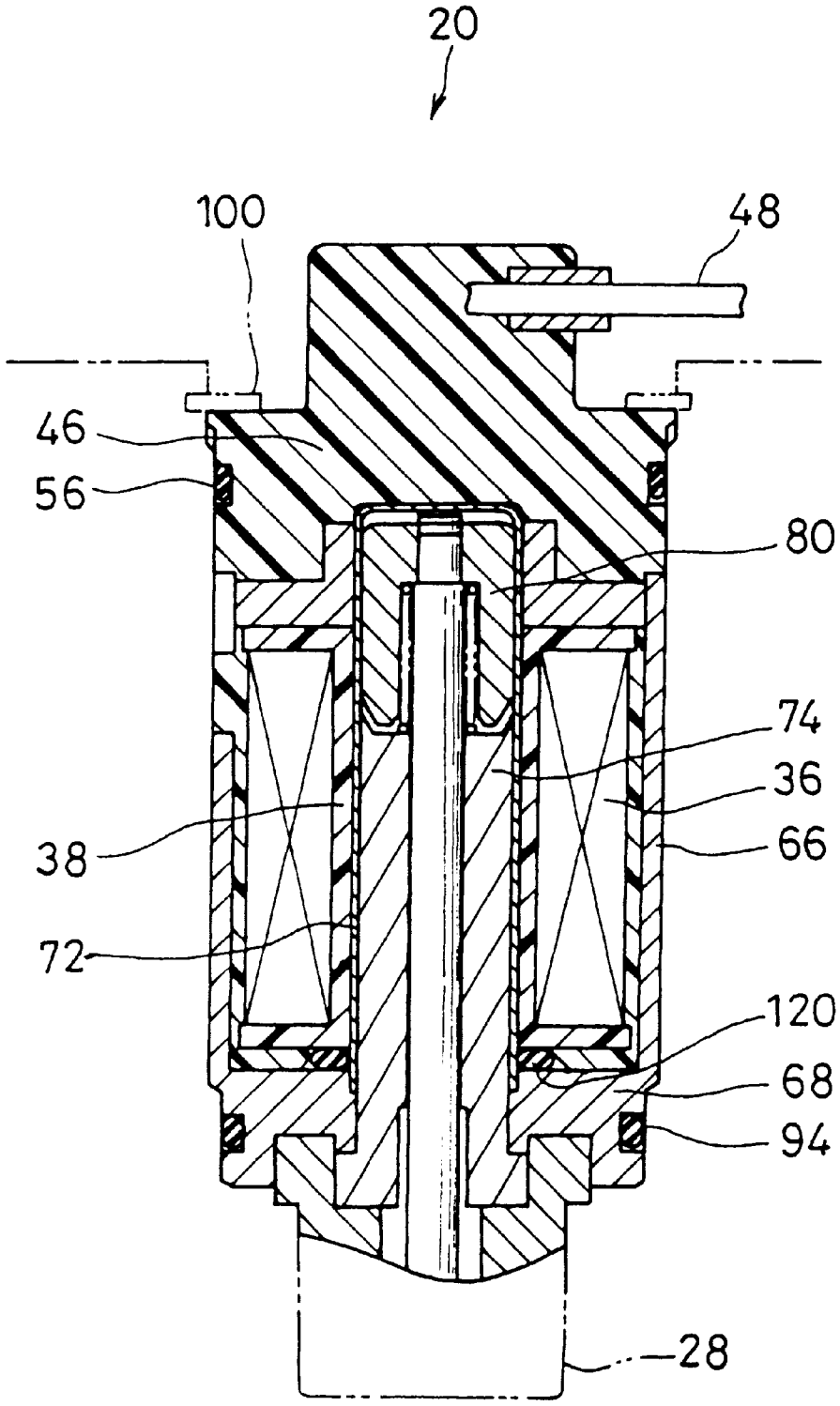
FIG. 6 is a view similar to FIG. 5 but showing the modified form of the solenoid actuator.

FIG. 6 shows a modified form of the solenoid actuator shown in FIG. 5. In the modified arrangement of FIG. 6, the spring washer 116 used in the embodiment of FIG. 5 is replaced by an O-ring 120 arranged between the upper and lower modules 32 and 34. As the modules 32 and 34 are assembled, the O-ring 120 is compressed and develops an axial bias to bring the lug 110 into engagement with the notch 112. In other respects, the arrangement is the same as that of the second embodiment.

Figure 7A:
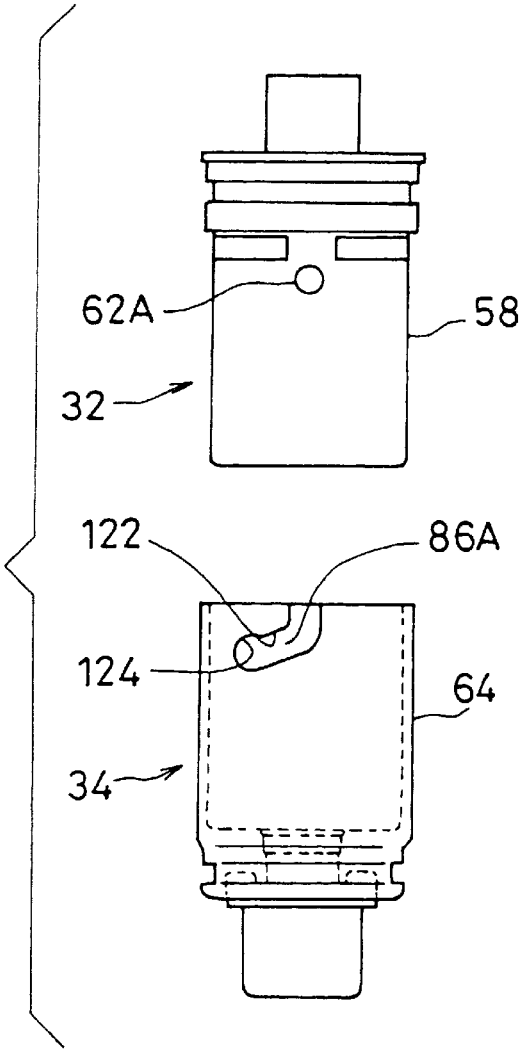
FIGS. 7A and 7B are views similar to FIG. 3 but showing the modified versions of the bayonet coupling of the two modules; and, FIG. 8 is a view similar to FIG. 2 but showing a solenoid valve incorporating the solenoid actuator according to another embodiment of the invention.
Figure 7B:
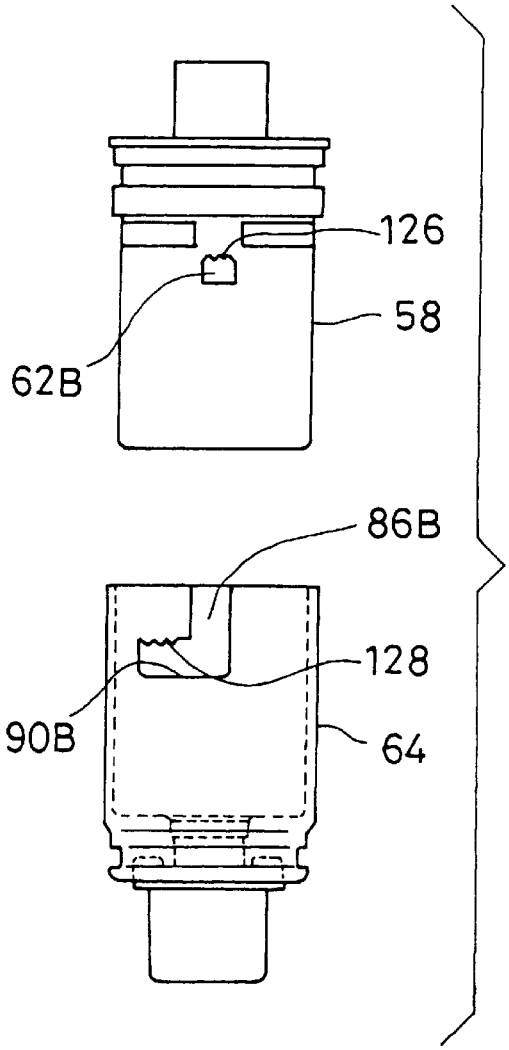

FIGS. 7A and 7B show the modified versions of the bayonet joint structure for coupling the upper and lower modules 32 and 34 with each other. In the arrangement of FIG. 7A, the projection 62A formed on the skirt 58 of the upper module 32 is made circular and the J-shaped slot 86A formed on the outer casing 64 has an inclined portion 122 terminated by an enlarged diameter portion 124. As the upper module 32 is inserted into the lower module 34 with the projection 62A engaged in the axial portion of the slot 86A and the upper module 32 is then turned relative to the lower module 34, the modules will be progressively brought closer with each other by the cam action the inclined slot 122. Finally, the projection 62A will snap-fit into the enlarged diameter portion 124 to positively lock the modules with each other.

In the layout shown in FIG. 7B, a series of teeth 126 are formed along the upper edge of the projection 62B and a series of serrated notches 128 are formed along the upper edge of the circumferential portion 90B of the J-shaped slot 86B. Positive lock between the modules 32 and 34 is achieved by the teeth 126 engaging the serrated notches 128.

Figure 8:
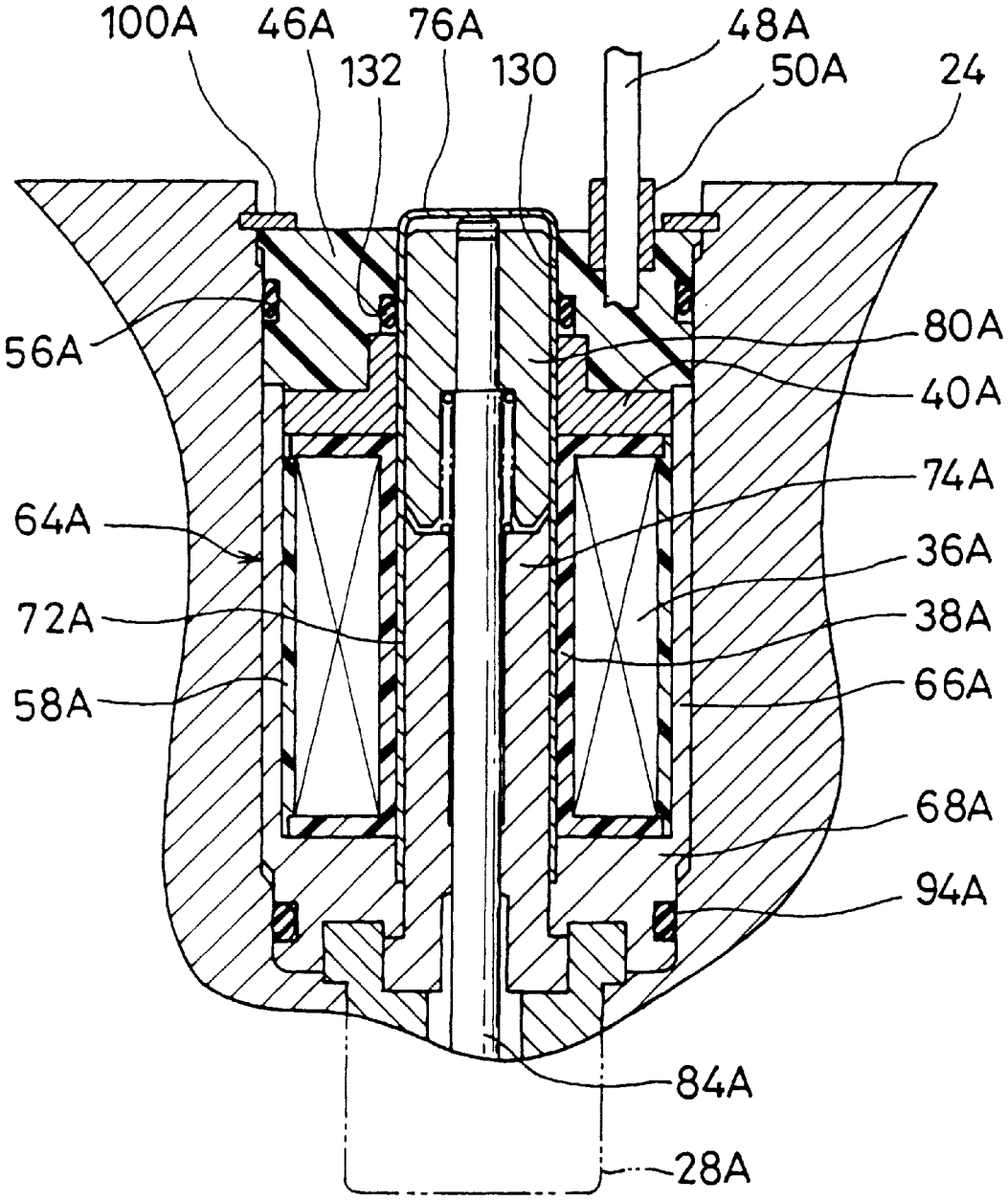

FIG. 8 illustrates a solenoid valve incorporating a solenoid actuator according to another embodiment of the invention. In FIG. 8, parts and members similar to those shown in FIG. 2 are designated by like reference numerals with a suffix "A" and, therefore, need not be described again.

To describe the difference, the feature of this embodiment is that the end cap member 46A made of plastics is provided with a central bore 130 through which extends the sleeve 72A made of stainless steel. An O-ring 132 is disposed between the sleeve 72A and the end cap member 46A to fluid-tightly seal them with each other.

Although in this embodiment the sleeve 72A is exposed to the ambient environment, it is rust free because it is made of stainless steel. Accordingly, the sleeve 72A effectively protects the armature and pole piece housed therein. The advantage of this embodiment is that it is possible to increase the axial length of either or both of the armature and the magnetic pole piece without increasing the overall axial size of the solenoid actuator.

While the present invention has been described herein with reference to the specific embodiments thereof, it is contemplated that the present invention is not limited thereby and various changes and modifications may be made therein for those skilled in the art without departing from the scope of the invention. In particular, although the solenoid actuator of invention has been described as incorporated in a solenoid valve, it should be noted that such application is only illustrative and the solenoid actuator of the invention may be installed or incorporated in other devices and apparatuses.

What is claimed is:

1. A fluid machine comprising in combination, (a) a machine housing having a mounting bore, (b) a fluid control valve arranged in said housing, (c) a solenoid actuator mounted in said mounting bore to control said control valve, said solenoid actuator comprising:

a solenoid coil having an upper and a lower end;

a magnetic pole piece disposed centrally of said solenoid coil;

a movable armature coaxially aligned with said pole piece and arranged for axial movement with respect thereto;

a return spring for biasing said armature away from said pole piece;

a magnetic yoke member disposed around said solenoid coil to magnetically couple said pole piece and said armature with each other to form a path of magnetic flux when said solenoid coil is energized, said magnetic yoke member including an outer casing fitted in said mounting bore an output rod connected at an end thereof to said armature and having the other end extending downwardly beyond said lower end of the solenoid coil; and, an end cap member, made of a non-corrodible material, overlying said yoke member, said armature and said pole piece, said end cap member being sized and configured to be closely fitted in said mounting bore of said housing to fluid-tightly close an opening of said mounting bore as said solenoid actuator is installed in said mounting bore to thereby protect said yoke member, said armature and said pole piece from attack by corrosive substance being present in the ambient environment, said outer casing being fluid tightly fitted in said mounting bore to disconnect a space between said outer casing and said mounting bore from the outside of the actuator.

2. A fluid machine according to claim 1, wherein said end cap member is provided at a circumferential periphery thereof with an annular groove and wherein an annular sealing member is fitted in said groove to fluid-tightly seal the end cap member relative to the housing.

3. A fluid machine according to claim 1, wherein said end cap member is made of a molded plastic material.

4. A fluid machine according to claim 3, wherein said end cap member is molded integrally with said solenoid coil.

5. A fluid machine according to claim 3, wherein said yoke member is made of an upper plate and a separate outer casing and wherein said upper plate is insert molded in said end cap member.

6. A fluid machine according to claim 5, further comprising a sleeve closed at the upper end thereof and made of a non-magnetizable, non-corrodible material, said armature and said magnetic pole piece being housed at least in part by said sleeve.

7. A solenoid actuator adapted to be installed within a mounting bore formed in a support housing, said solenoid actuator comprising:

a solenoid coil having an upper and a lower end;

a magnetic pole piece disposed centrally of said solenoid coil;

a movable armature coaxially aligned with said pole piece and arranged for axial movement with respect thereto;

a return spring for biasing said armature away from said pole piece;

a magnetic yoke member disposed around said solenoid coil to magnetically couple said pole piece and said armature with each other to form a path of magnetic flux when said solenoid coil is energized;

an output rod connected at an end thereof to said armature and having the other end extending downwardly beyond said lower end of the solenoid coil;

an end cap member, made of a non-corrodible material, overlying said yoke member, said armature and said pole piece, said end cap member being sized and configured to be closely fitted in said mounting bore of said housing to fluid-tightly close an opening of said mounting bore as said solenoid actuator is installed in said mounting bore to thereby protect said yoke member, said armature and said pole piece from attack by corrosive substance being present in the ambient environment;

wherein said end cap member is made of a molded plastic material;

wherein said end cap member is molded integrally with said solenoid coil;

wherein said yoke member is made of an upper plate and a separate outer casing and wherein said upper plate is insert molded in said end cap member;

a sleeve closed at the upper end thereof and made of a non-magnetizable, non-corrodible material, said armature and said magnetic pole piece being housed at least in part by said sleeve; and wherein said solenoid actuator is comprised of separately prefabricated upper and lower sections adapted to be detachably coupled with each other, said upper section including said end cap member, said upper plate and said solenoid coil molded integrally with each other, said lower section including said outer casing joined with said sleeve housing said armature and said pole piece.

8. A solenoid actuator according to claim 7, wherein said upper and lower sections are coupled with each other by a bayonet coupling mechanism including a J-shaped slot formed in one of said sections and a projection formed on the other section.

9. A solenoid actuator according to claim 8, further comprising means for preventing relative rotation of said sections once they have been coupled with each other.

10. A solenoid actuator according to claim 9, wherein said means for preventing relative rotation includes a notch which is formed at the end of said slot and in which said projection engages as said sections have been coupled with each other.

11. A solenoid actuator according to claim 10, further comprising means for axially biasing said projection into engagement with said notch.

12. A solenoid actuator according to claim 9, wherein said means for preventing relative rotation includes a series of serration formed on a side of said slot and a plurality of teeth formed on the opposite side of said projection facing said teeth.

13. A solenoid actuator according to claim 9, wherein said means for preventing relative rotation includes permanent deformation of one of said slot and said projection.

14. A fluid machine according to claim 1, further comprising a circlip for axially locating said actuator as it is installed in said mounting bore, said circlip being adapted to be fitted in a groove formed on the inner wall of said mounting bore.

15. A fluid machine comprising in combination, (a) a machine housing having a mounting bore and an annular groove formed on the inner wall of said mounting bore in the vicinity of an outer end of said bore, (b) a fluid control valve arranged in said housing, (c) a solenoid actuator mounted in said mounting bore to control said control valve, said solenoid actuator comprising:

a solenoid coil;

a magnetic pole piece disposed centrally of said solenoid coil;

a movable armature coaxially aligned with said pole piece and arranged for axial movement with respect thereto;

a return spring for biasing said armature away from said pole piece;

a magnetic yoke member disposed around said solenoid coil to magnetically couple said pole piece and said armature with each other to form a path of magnetic flux when said solenoid coil is energized;

an output rod connected at an end thereof to said armature and at the other end to said control valve; and, an end cap member, made of a non-corrodible material, overlying said yoke member, armature and pole piece;

said end cap member being closely fitted in said mounting bore of said housing to protect said yoke member, said armature and said pole piece from attack by corrosive substance; and, (d) means mounted in said annular groove for axially locating said end cap member.

16. A fluid machine as defined in claim 15, wherein said actuator is confined substantially within said mounting bore of the machine housing.

17. A fluid machine as defined in claim 16, wherein said end cap member is provided at the circumferential periphery thereof with an annular groove and wherein an annular sealing member is fitted in said groove to fluid-tightly seal the end cap member with respect to the housing.

18. A fluid machine comprising in combination, (a) a machine housing having a mounting bore and an annular groove formed on the inner wall of said mounting bore in the vicinity of an outer end of said bore, (b) a fluid control valve arranged in said housing, (c) a solenoid actuator mounted in said mounting bore to control said control valve, said solenoid actuator comprising:

a solenoid coil;

a sleeve closed at an outer end thereof and disposed centrally of said solenoid coil, said sleeve being made of a non-magnetizable, non-corrodible material;

a magnetic pole piece received at least in part in said sleeve;

a movable armature received in said sleeve for axial movement with respect to said pole piece;

a return spring for biasing said armature away from said pole piece;

a magnetic yoke member partly surrounding said solenoid coil to magnetically couple said pole piece and said armature with each other to form a path of magnetic flux when said solenoid coil is energized;

an output rod connected at an end thereof to said armature and at the other end to said control valve; and, an end cap member, made of a non-corrodible material, surrounding the outer part of said sleeve to cover said yoke member, said end cap member being closely fitted between said mounting bore and said sleeve to protect said yoke member from attack by corrosive substance; and, (d) means mounted in said annular groove for axially locating said end cap member.

* * * * *